US008408953B2

(12) United States Patent
Bremsjö et al.

(10) Patent No.: US 8,408,953 B2
(45) Date of Patent: Apr. 2, 2013

(54) ARRANGEMENT AND METHOD FOR CONTROLLING A PROPELLER DRIVE ON A BOAT

(75) Inventors: Lars Bremsjö, Olofstorp (SE); Dan Olsson, Hovås (SE); Stig Ursing, Vastra Frolunda (SE)

(73) Assignee: AB Volvo Penta, Gothenburg (SE)

( * ) Notice: Subject to any disclaimer, the term of this patent is extended or adjusted under 35 U.S.C. 154(b) by 1385 days.

(21) Appl. No.: 11/553,404

(22) Filed: Oct. 26, 2006

(65) Prior Publication Data

US 2007/0046242 A1 Mar. 1, 2007

Related U.S. Application Data

(63) Continuation of application No. PCT/SE2004/000651, filed on Apr. 26, 2004.

(51) Int. Cl.
*B63H 21/22* (2006.01)

(52) U.S. Cl. ..... 440/1

(58) Field of Classification Search ..... 440/53, 440/1

See application file for complete search history.

(56) References Cited

U.S. PATENT DOCUMENTS

| | | | | |
|---|---|---|---|---|
| 3,349,744 | A | 10/1967 | Marcier | |
| 3,913,517 | A | 10/1975 | Lohse et al. | |
| 4,595,867 | A | 6/1986 | Cognevich, Sr. et al. | |
| 4,890,979 | A * | 1/1990 | Ames et al. | 416/46 |
| 5,029,547 | A * | 7/1991 | Novey | 114/159 |
| 5,361,024 | A | 11/1994 | Wisner et al. | |
| 2002/0197918 | A1 * | 12/2002 | Aarnivuo | 440/53 |
| 2003/0079668 | A1 | 5/2003 | Morvillo | |
| 2004/0226768 | A1 * | 11/2004 | DeLuca et al. | 180/275 |

FOREIGN PATENT DOCUMENTS

SE 508314 C2 9/1998

* cited by examiner

*Primary Examiner* — Stephen Avila
(74) *Attorney, Agent, or Firm* — Novak Druce Connolly Bove + Quigg LLP

(57) ABSTRACT

An arrangement and a method for controlling a propeller drive on a boat including a propeller drive suspended in a housing that can rotate, a servo motor which is arranged to rotate said rotating housing, a control unit which is arranged to control the servo motor in response to an input signal from a control device, corresponding to a required position of the rotating housing.

18 Claims, 6 Drawing Sheets

(a)

(b)

(c)

(d)

ARRANGEMENT AND METHOD FOR CONTROLLING A PROPELLER DRIVE ON A BOAT

CROSS-REFERENCE TO RELATED APPLICATIONS

The present application is a continuation patent application of International Application No. PCT/SE2004/000651 filed 26 Apr. 2004 which is published in English pursuant to Article 21(2) of the Patent Cooperation Treaty. Said application is expressly incorporated herein by reference in its entirety.

FIELD

The present invention relates to an arrangement for controlling a propeller drive on a boat. In particular, it relates to an arrangement for controlling a propeller drive suspended in a housing that can rotate, with the rotation of the housing being controlled by a servo motor controlled by a control unit in response to an input signal emitted by a control device, corresponding to a required position of the propeller drive.

The present invention also relates to a method for controlling a propeller drive in a boat and which includes controlling a propeller drive suspended in a rotating housing by means of a servo motor which rotates said rotating housing in response to an input signal from a control device, corresponding to a required position (θ) of the rotating housing.

BACKGROUND

With conventional steering of boats with controllable propeller drives, a mechanical power transmission or mechanical power transmission connected to a hydraulic system is used for power amplification from a wheel to the propeller drive, an example of such a system being given in U.S. Pat. No. 5,399,112. This type of steering is well-suited for boats equipped with one drive, and for boats where the distance between the wheel and actuator for the controllable propeller drive is not such that the laying of cables between the wheel and actuator constitutes a problem.

For boats equipped with several drives and for boats where it is not desirable to have mechanical or hydraulic power transmission from the position where the wheel is located to actuators for setting the position of the propeller drives, it is expedient to utilize electronic control of the actuators. This applies in particular for a type of boat which is driven at planing speeds and is designed with a V-bottomed hull designed for planing, with an individually-controllable drive suspended on each side of the center line of the hull. These drives comprise an underwater housing projecting downwards from the outside of the hull, suspended in such way that it can be rotated in relation to the hull. A drive shaft is mounted in the underwater housing in such a way that it can rotate. The drive shaft drives a propeller shaft that is at least essentially horizontal via a bevel gear mechanism contained in the underwater housing. Such a type of boat is known in, for example, SE-9402272-0. As the drives are suspended at right angles to the bottom of the hull on each side of the center line of the V-shaped hull, the drive shafts will be angled in relation to each other. This means that a mechanical power transmission for steering both drives would be very complex, in particular in the case when individual steering of the drives is required in response to movements of the wheel.

To achieve the abovementioned object, it is advantageous to utilize electronic control of steering for a propeller drive on a boat comprising a propeller drive suspended in a housing that can be rotated.

With the utilization of electronic control systems for boats, it is of the greatest importance that the control systems should be reliable. Incorrect steering can result in unnecessary wear and tear on bearings and other components comprised in the boat's driveline. Incorrect steering can also mean that the boat's maximum performance cannot be utilized, which is the case when a boat equipped with two propeller drives does not correctly set the direction of the propeller drives and hence the direction of the propulsive thrust.

In order to ensure that the steering is correct, it is proposed in US 2003/0079668 that an electronic control system is continually calibrated. This patent application describes an electronic control system for a boat with waterjet operation. Calibration in association with starting up the vessel, so-called "dockside calibration", is carried out, where all actuators for active steering of the waterjet unit's intake are moved from one end position to the other. At the same time, the helmsman is to move control devices in the form of a wheel and joystick to the respective extreme positions. Although this type of calibration ensures that the control system is functioning correctly, the calibration is time-consuming and also requires the helmsman's active participation. This means that the helmsman may perceive the calibration as troublesome and as a result may skip the calibration procedure. As the calibration, and hence the function test of the control system, requires something to be carried out by hand, there is also a danger that the helmsman will forget to carry out the calibration.

In the event that a fault arises in the control system as described in US 2003/0079668 that is of such a kind that the calibration function is not reliable, a boat that utilizes the system proposed therein will display unstable steering characteristics. By unstable steering characteristics is meant an unforeseeable deviation between the course specified by a control device and the course on which the boat is traveling.

SUMMARY

The object of the invention is to provide an arrangement for controlling a propeller drive on a boat where the risk of the occurrence of unstable controlling characteristics is reduced. The invention utilizes an arrangement which comprises a safety brake which is arranged to lock a rotating housing, in which a propeller drive is arranged, to prevent rotation in the event of the detection of a fault in the control of the propeller drive. By applying the safety brake, it is ensured that unforeseeable deviation is avoided between the course indicated by control devices and the course upon which the boat is traveling.

According to a preferred embodiment of the invention, the arrangement comprises a monitoring device which is arranged to ascertain that a fault has arisen in the control of the propeller drive and to apply said safety brake in the event of the detection of a fault in the control of the propeller drive. By arranging the monitoring device, which is arranged to ascertain that a fault has arisen in the control and thereafter to apply the arrangement's safety brake, to be separate from the control unit which controls the servo motor for setting the rotating housing in response to an input signal from a control device^ it is ensured that a fault in the function of the control unit does not necessarily mean that the monitoring device is faulty. A higher degree of functional redundancy is obtained in this case than if the control unit also controlled the verification that a fault had arisen and was responsible for applying the safety brake.

In advantageous embodiment, the control unit comprises a first microcomputer which is arranged to execute a control program for the servo motor and the monitoring device comprises a second microcomputer which is arranged to execute a monitoring program in order to ascertain that a fault has arisen in the control of the propeller drive and to apply said safety brake, in the event of the detection of a fault in the control of the propeller drive.

The first and second microcomputers consist suitably of two separate units, each of which comprises at least a processor and memory.

In order to ascertain that a fault has arisen in the control of the drive, the monitoring device suitably utilizes an input signal from a position sensor which is arranged to detect an angular position of said rotating housing, corresponding to the actual position, and an input signal from the control device, corresponding to a required position.

In addition, according to an embodiment of the invention, the monitoring device is arranged to ascertain that a fault has arisen in the control of the propeller drive if a first function of the difference between the actual position and the required position is greater than a first limit value and/or a second function of the convergence speed of the actual position towards the required position is less than a second limit value and/or is greater than a third limit value. In this way, the condition for detecting a fault can be made to depend, for example, on the size of the control fault, the control fault's variation in the time or the speed of convergence, that is the time derivative or differential of the control fault. In addition, a test can be carried out in which it is investigated whether a third function of the acceleration of the actual position is less than the fourth limit value and/or is greater than a fifth limit value. In this case, it is investigated whether the power control in the control system is correct. By the control fault is meant here the difference between the actual position and the required position.

In an additional embodiment, the monitoring device is arranged to carry out verification that there is a fault in the control before the safety brake is applied, when the monitoring device has ascertained that there is a fault in the control. By not applying the brake immediately when the monitoring unit has detected that there is a fault in the control of the drive, better driving characteristics of the boat can be achieved by ensuring that the brake is not applied unnecessarily often. The verification is suitably carried out by means of a time delay before the application of said safety brake from the time that the monitoring device has ascertained that a fault has arisen in the control of the propeller drive. At the end of the time delay, the monitoring device can check whether the fault is still remaining and thereafter apply the brake. The size of the time delay is suitably dependent upon the size of the control fault, the control fault's variation in the time or the speed of convergence; that is, the time derivative or the differential of the control fault.

BRIEF DESCRIPTION OF THE DRAWINGS

The invention will be described below in greater detail with reference to the attached drawings, in which.

DETAILED DESCRIPTION

Figure 1:
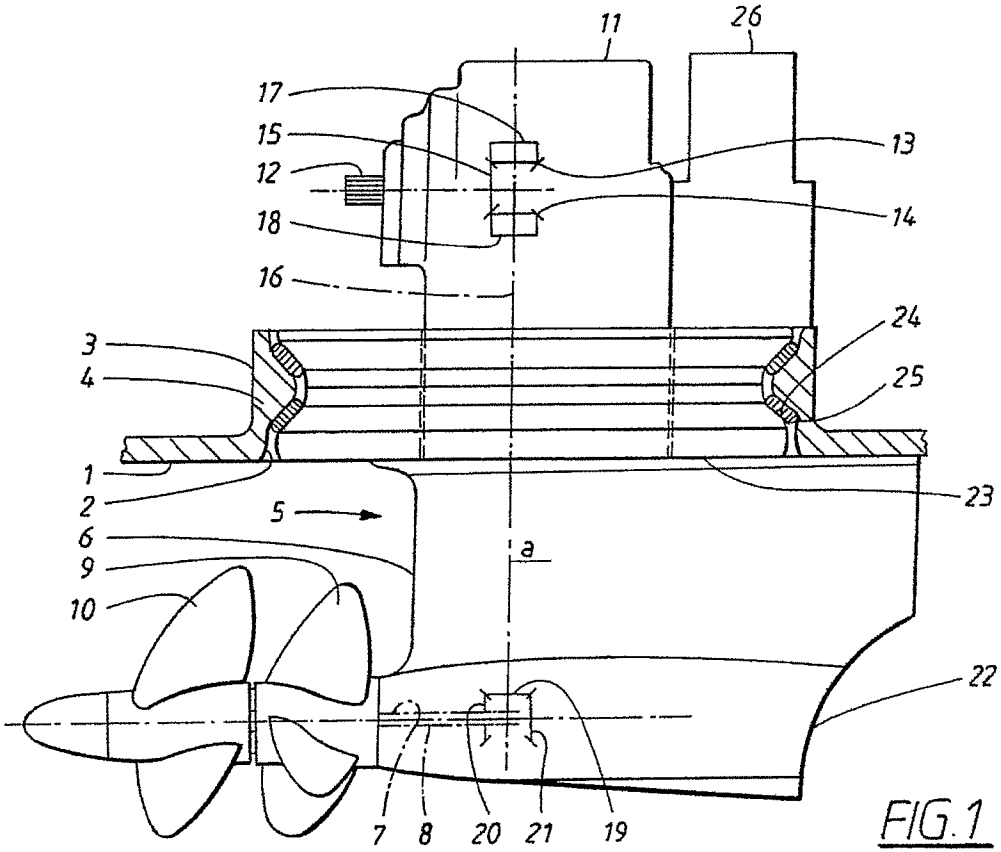
FIG. 1 shows a longitudinal section through a part of a boat bottom equipped with a drive of a type with which the invention can be utilized.

In FIG. 1, the bottom of a boat's hull, designated 1, can consist of molded glass fiber reinforced polyester plastic. The bottom of the hull is designed with an opening 2, which is surrounded by a vertical sleeve 3, which projects up into the interior of the hull. The sleeve is preferably molded in one piece with the bottom 1 and is designed with an internal peripheral flange 4 which, in the embodiment shown, has an essentially triangular cross section.

The sleeve 3 with the flange 4 forms a suspension device for a propeller drive designated in general by 5 which, in the embodiment shown, has an underwater housing 6, in which two concentric propeller shafts 7 and 8, each with a propeller 9 and 10, are mounted in such a way that they can rotate. The underwater housing 6 is connected to a gearbox 11, in which a horizontal drive shaft 12 is mounted in such a way that it can rotate. The shaft 12 is designed to be connected to an outgoing shaft from a motor (not shown). The shaft 12 drives a vertical shaft 16 via a bevel gear enclosed in the gear box 11, which bevel gear comprises conical gear wheels 13, 14 and 15. The gear wheels 13 and 14 are mounted on the shaft 16 in such a way that they can rotate or alternatively can be locked on the shaft by means of a multi-disc lubricated disc clutch 17 and 18 respectively to drive the shaft 16 in either rotational direction. The shaft 16 drives the propeller shafts 7 and 8 in opposite rotational directions via a bevel gear enclosed in the underwater housing 6 and comprising gear wheels 19, 20 and 21. In the embodiment shown, the propellers 9 and 10 are tractor propellers arranged in front of the underwater housing 6, at the rear end of which there is an outlet 22 for exhaust gases.

The drive 5 is suspended in the opening 2 by means of a suspension element designated in general by 3, which engages around the flange 4 with interlayers consisting of a pair of vibration-suppressing and sealing flexible rings 24 and 25. The underwater housing 6 is mounted in the suspension element 23 in a way that is not described in greater detail so that it rotates around an axis of rotation "a" coinciding with the drive shaft 16. The rotation of the underwater housing 6 is achieved by means of a servo motor 26 that can be an electric motor with a gear wheel fixed on a shaft engaging with a gear ring connected to the underwater housing.

Figure 2:
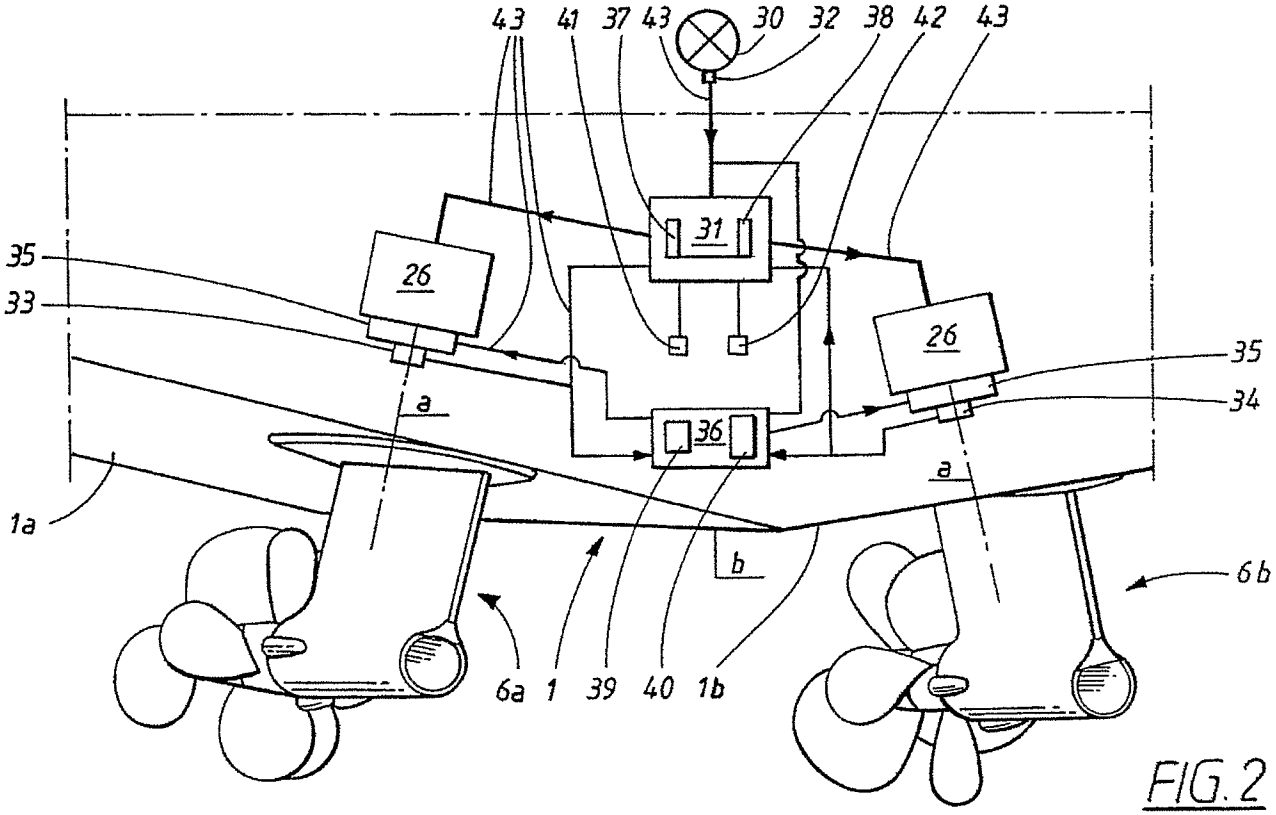
FIG. 2 shows a schematic illustration of the aft section of a boat with two drives of a type with which the invention can be utilized.

FIG. 2 shows the aft section of the hull of a boat with a V-shaped bottom 1. In each bottom section 1*a* and 1*b* respectively and at an equal distance from the center line "b" of the bottom, drives are suspended with underwater housings 6*a* and 6*b* of the type shown in FIG. 1. The underwater housings 6*a* and 6*b* can be suspended in the way that is illustrated in FIG. 1. In FIG. 2, a control device at a helm, in the form of, for example, a wheel or a joystick, is indicated by 30, and 31 is an electronic control unit that can comprise a computer. The control unit 31 is connected electrically to servo motors 26 for each drive. By means of the respective servo motors 26, the drives' underwater housings can be rotated independently of each other around their axes of rotation "a" in response to signals from the control unit 31 for controlling the boat.

The wheel 30 is linked with a sensor 32 which detects the movement of the wheel from an initial position, for example driving straight forwards, and sends a signal to the control unit 31 in response to the movement of the wheel. The control unit 31 comprises a first microcomputer which is arranged to execute a control program for the servo motor 26. The microcomputer comprises at least a processor 37 and a memory 38. In addition, there are position sensors 33 and 34 arranged to detect the angle of rotation of the underwater housings 6*a* and 6*b* around the axes of rotation "a". The position sensors 33 and 34 communicate with the control unit 31. Where appropriate, a control unit can be utilized for each drive 5. In the embodiment shown, a shared control unit is utilized.

In addition, a safety brake 35 controlled by said control unit is arranged in association with each servo motor 26. The safety brake is arranged to lock said rotating housing so that it cannot rotate. This can be achieved, for example, by a brake yoke in the brake being brought into engagement with an extension of the rotating underwater housing 6*a*, 6*b* or by a brake yoke in the brake being brought into engagement with the motor or with parts of the transmission between the motor and the rotating housing. The safety brake is preferably designed in such a way that the brake is brought into engagement when an actuator in the brake is inactive. This can be achieved by a spring bringing the brake into engagement and by an actuator releasing the load on the brake when the housing is to be released in order that it can rotate. The actuator can be in the form of a solenoid or alternatively in the form of a pneumatic or hydraulic piston.

For the activation of the safety brake 35 and for the detection of a fault in the control of the propeller drive, the arrangement comprises a monitoring device 36. The monitoring device 36 comprises a second microcomputer which is arranged to execute a monitoring program in order to ascertain whether there is a fault in the control of the propeller drive and to apply said safety brake in the event of the detection of a fault in the control of the propeller drive. The microcomputer comprises a processor 39 and a memory 40. The first microcomputer, which is comprised in the control unit, and the second microcomputer, which is comprised in the monitoring unit, consisting preferably of two separate units.

The monitoring device 36 is connected to the position sensors 33, 34 from which input signals are generated, corresponding to the current position of the rotating housings. The monitoring device 36 is connected, in addition, to the control device's sensor 32, the input signals from which specify a required position.

Figure 3:
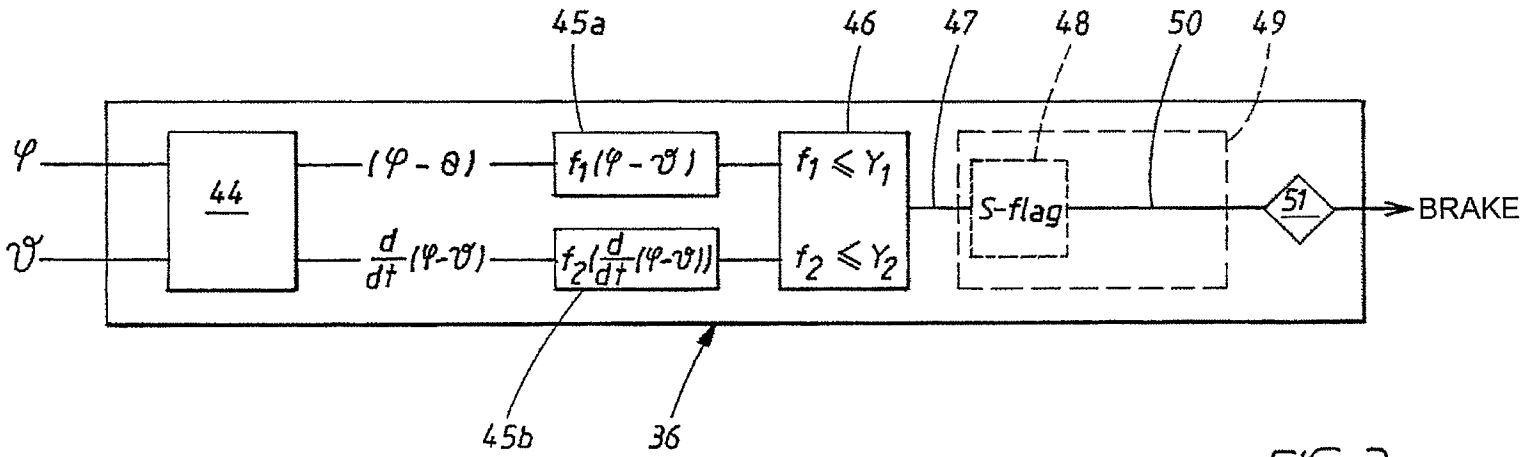
FIG. 3 shows a block diagram for a embodiment of the monitoring device.

The monitoring device 36 ascertains that there is a fault in the control according to the principles that are described below with reference to FIG. 3 which shows a block diagram for an embodiment of the monitoring device 36. The monitoring device 36 receives input data in the form of an input signal $\phi$ from a position sensor 33 (or several position sensors, 33, 34, if several controllable propeller drives are mounted on the boat). In addition, the monitoring device 33 receives input data in the form of an input signal $\theta$ from a sensor 32 in a control device 31, where the input signal corresponds to a required position.

The monitoring device communicates with position sensors 33, 34 and the sensor 32 in any way known to experts in the field, for example by the use of a communication network 43 which links together position sensors, sensors, the control unit, the monitoring device and other components in the boat's electronic system, such as for example a motor control unit.

In a first function block 44, a measurement of the control fault is generated, that is the difference between the actual position $\phi$ and the required position $\theta$ and/or the differential or derivative of the control fault. In a second function block 45*a*, a first function $f_1$ of the control fault is generated. This function can be designed to give a measurement of the seriousness of the fault. For example, an integration or summation can be utilized, whereby the value of the function increases with the duration of the control fault in time. Alternatively, the function can be proportional to the size of the fault, whereby a fault will be indicated as soon as the control fault exceeds a certain value. In addition, an integration or summation can be combined with a weighting function so that major control faults have a greater effect than what a proportional weighting would give. For example, the control fault can be squared before integration, which also means that negative contributions of the control fault can be eliminated. In a third function block 45*b*, a function $f_2$ is generated of the differential or time derivative of the control fault. This function is designed to give a measurement of how serious the fault is according to the principles that are described above in association with the creation of the function $f_1$ of the control fault. According to an embodiment of the invention, a monitoring device is utilized where only the control fault is used to ascertain whether there is a fault in the control of the propeller drive; in an alternative embodiment, only the time derivative or the differential of the control fault can be used. Preferably both the control fault and its time derivative are used.

In a fourth function block 46, the value of the first function $f_1$ of the control fault is compared with a first limit value $\gamma_1$. According to a first embodiment, if the value is greater than the limit value, an output signal 47 is generated, indicating that there is a fault in the control of the propeller drive. In addition, a comparison can be carried out of the value of the second function $f_2$ of the speed of convergence between the required and actual position that is the differential or derivative of the control fault, with a second limit value $\gamma_2$ and/or a third limit value $\gamma_3$. According to a second embodiment, if the value is less than the second limit value, an output signal 47 is generated, indicating that the actual position is converging too slowly towards the required position and accordingly that there is a fault in the control of the propeller drive. In addition, according to an alternative embodiment, if the value is greater than the third limit value, an output signal 47 is generated, indicating that the actual position is converging too quickly towards the required position and accordingly that there is a fault in the control of the propeller drive. In addition, it can also be tested whether a third function $f_3$ of the acceleration of the actual position is less than a fourth limit value $\gamma_4$ and/or is greater than a fifth limit value $\gamma_5$.

The first, second and third functions consist preferably of simple functions, such as, for example, the absolute amount of the measured value or a square of the measured value. The function can also be a null transformation and quite simply correspond to the measured value, that is the difference between the actual and required position, the speed of convergence towards the required position and/or the acceleration of the actual position.

According to a third embodiment, an output signal can be generated indicating that there is a fault if the value of either function is greater than its limit value. Alternatively, a more complex limit value, which is a weighted combination of both the first and the second limit value, can be utilized.

According to an embodiment, the output signal 47 constitutes an input signal to the fifth function block 48 which is arranged in the monitoring device 36 in an embodiment of the invention. The fifth function block is comprised in means 49 for verifying that there is a fault. According to an embodiment, this means 49 is designed as a time delay where a fault in the control of the propeller shaft must exist for an interval of time before a signal to activate the brake is to be generated by the monitoring device 36. For the purpose of creating a time delay, the fifth function block 48 can consist of a flag which changes state when a fault first arises. The flag retains its state as long as the fault occurs. When the duration of the time delay has expired, which can take place after a variable interval of time depending upon the size of the fault, an output signal 50 is generated, indicating that the control fault has been verified. The output signal 50 constitutes the input signal to a sixth function block 51 which generates an output signal 52 intended to activate a brake.

Figure 4:
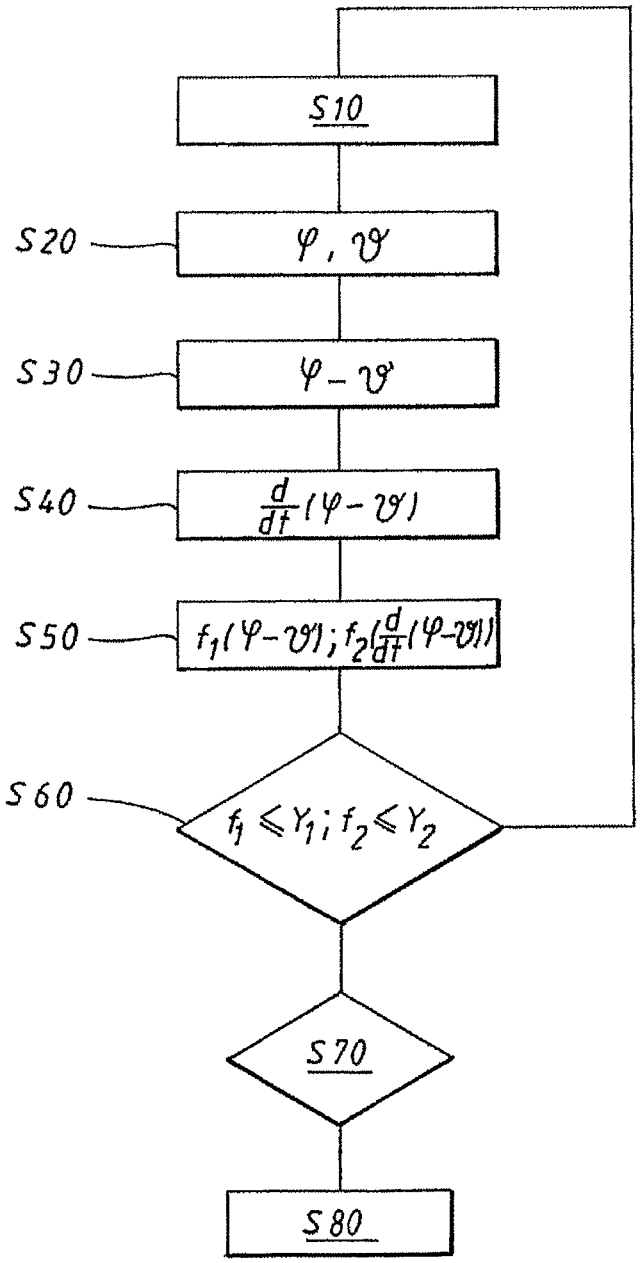
FIG. 4 shows a flow chart for a method for controlling a propeller drive according to the invention.

FIG. 4 shows a flow chart for a method for controlling a propeller drive according to the invention. In a first method step S10, controlling is carried out of a propeller drive suspended in a rotating housing using a servo motor which rotates said rotating housing in response to an input signal from a control device, corresponding to a required position of the rotating housing. The control can be carried out by means of simple desired value controlling, such as feedback controlling where the desired value is compared with an actual value, or by means of more advanced feedback control algorithms such as PI, PID or some other control algorithms known to experts in the field.

In a second method step S20, the monitoring device 36 receives an input signal from a position sensor which is arranged to detect an angular position of the rotating housing, corresponding to the actual position $\phi$, and an input signal from the control device, corresponding to a required position $\theta$.

In a third method step S30, a value is created for the control fault, that is the difference between the actual value $\phi$ and an input signal from the control device, corresponding to a required position $\theta$. In this step, the absolute amount of the control fault can also be created, according to an embodiment of the invention.

In a fourth method step S40, the time derivative or differential of the control fault is created. This fourth step can be omitted, according to an alternative embodiment of the invention.

In a fifth method step S50, a first and/or a second function of the control fault or the derivative or differential of the control fault is created.

In a sixth method step S60, the value of the first and/or second function is compared with the respective limit value or a combined limit value.

In a seventh method step S70, according to an embodiment of the invention, it is verified that there is a fault, in accordance with the means for verification described above. This seventh step can be omitted, according to an alternative embodiment of the invention.

In an eighth method step S80, an output signal is generated for activating the brake if a fault in the control is ascertained in the sixth method step and, if there is a method step concerning verification of the fault, after verification that there is a fault has been carried out in the eighth method step.

Figure 5:
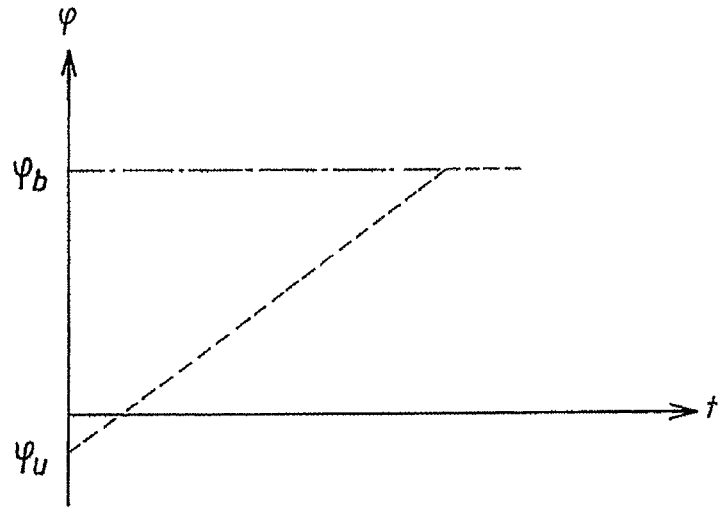
FIG. 5 shows a number of diagrams in which the angle of rotation $\phi$ is indicated as a function of the time (t).
Figure 5:
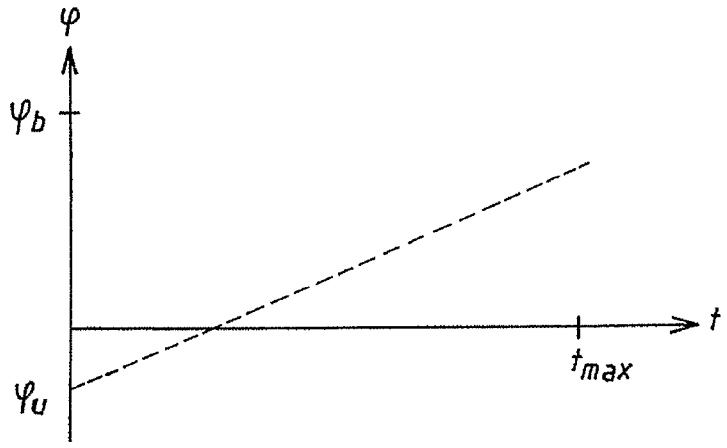
Figure 5:
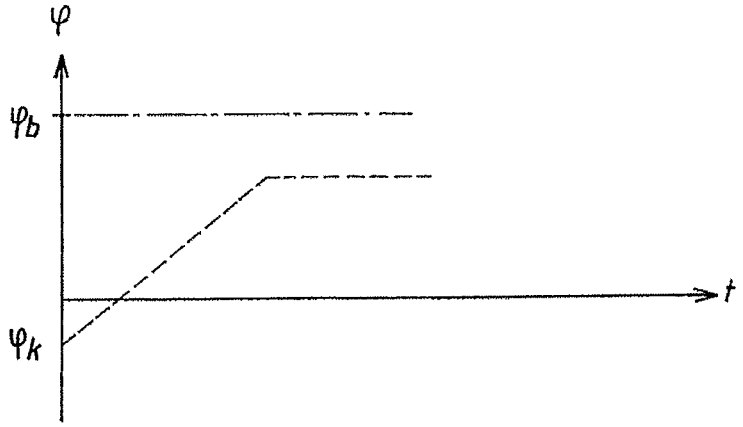
Figure 5:
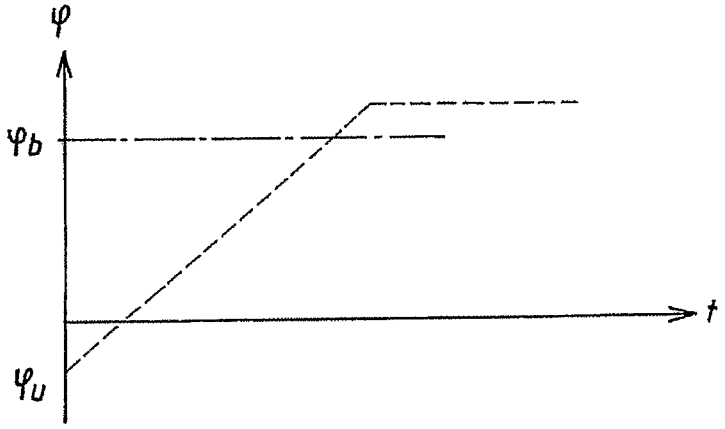

FIG. 5 shows a number of diagrams where the angle of rotation $\phi$ is indicated as a function of the time. In FIG. 5*a*, a test result is shown where controlling of the propeller drive is working and where the safety brake has not been applied. The position sensor has recorded how the housing has rotated from the initial position $\phi$ to the required position $\theta$. In addition, the movement has been carried out at a relatively constant speed. According to an embodiment of the invention, a deviation from a constant speed of rotation can be interpreted as a fault arising in the control of the drive.

FIGS. 5*b*-5*d* show various examples of test results where the control of the propeller drive is not working. In FIG. 5*b*, the speed of rotation of the housing is too low. In FIG. 5*c*, the rotation has stopped before the housing has assumed the required position. In FIG. 5*d*, the rotation has stopped after the housing has passed the required position.

In the embodiment shown in FIG. 2, signals are also input into the control unit 31 from a tachometer 41 and a log 42 for providing information about whether the boat is being driven below or above its planing threshold. In principle, it is sufficient to have signals from the tachometer 41 or the log 42 for information about the speed of the boat. In the control unit 31, various values of the drives' control angles are stored as a function of the movement of the wheel 30.

What is claimed is:

1. An arrangement for controlling the angular position of a propeller drive (5) on a boat comprising a propeller drive (5) suspended in a housing (6) that can rotate, a servo motor (26) which is arranged to rotate said rotating housing (6), a control unit (31) which is arranged to control the servo motor (26) in response to an input steering signal from a control device (30), corresponding to a required position of the rotating housing (6), characterized in that the arrangement comprises a safety brake (35) which is arranged to lock said rotating housing (6) to prevent rotation in the event of the detection of a fault in the angular position control of the propeller drive (5).

2. The arrangement according to claim 1, characterized in that the arrangement comprises a monitoring device (36) which is arranged to ascertain that there is a fault in the angular position control of the propeller drive (5) and to apply said safety brake (35) in the event of the detection of a fault in the angular position control of the propeller drive (5).

3. The arrangement according to claim 2, characterized in that the control unit (31) comprises a first microcomputer which is arranged to execute a control program for the servo motor (26) and the monitoring device (36) comprises a second microcomputer which is arranged to execute a monitoring program in order to ascertain that there is a fault in the angular position control of the propeller drive (5) and to apply said safety brake (35) in the event of the detection of a fault in the angular position control of the propeller drive.

4. The arrangement according to claim 3, characterized in that the first and the second microcomputer consist of two separate units, each of which comprises at least a processor (37, 39) and a memory (38, 40).

5. The arrangement according to claim 1, characterized in that the monitoring device (36) is arranged to ascertain that there is a fault in the angular position control of the propeller drive on the basis of an input signal from a position sensor (33, 34) which is arranged to detect an angular position of said rotating housing (6), corresponding to the actual position, and an input signal from the control device (30), corresponding to a required position.

6. The arrangement according to claim 5, characterized in that the monitoring device (36) is arranged to ascertain that there is a fault in the angular position control of the propeller drive (5) if a first function ($f_1$) of the difference between the actual position ($\phi$) and the required position ($\theta$) is greater than a first limit value ($\gamma_1$) and/or a second function ($f_2$) of the convergence speed of the actual position ($\phi$) towards the required position ($\theta$) is less than a second limit value ($\gamma_2$) and/or is greater than a third limit value ($\gamma_3$) and/or a third function ($f_3$) of the acceleration of the actual position is less than a fourth limit value ($\gamma_4$) and/or is greater than a fifth limit value ($\gamma_5$).

7. The arrangement according to claim 6, characterized in that the monitoring device (36) is arranged to carry out a verification that is there is a fault in the angular position control before the safety brake (35) is applied when the monitoring device (36) has ascertained that there is a fault in the control.

8. The arrangement according to claim 7, characterized in that said verification is carried out by a time delay of the application of said safety brake (35) from the time that the monitoring device (36) ascertained that there was a fault in the angular position control of the propeller drive.

9. The arrangement according to claim 8, characterized in that the size of said time delay is dependent upon said first and/or second function.

10. A method for controlling the angular position of a propeller drive in a boat comprising the following method steps: controlling (S10) the angular position of a propeller drive (5) suspended in a rotating housing (6) by means of a servo motor (26) which rotates said rotating housing (6) in response to an input signal from a control device (30), corresponding to a required position (θ) of the rotating housing (6), characterized in that a safety brake (35) locks said rotating housing (6) to prevent rotation, in the event of the detection of a fault in the angular position control of the propeller drive.

11. The method according to claim 10, characterized in that a monitoring device (36) ascertains that there is a fault in the angular position control of the propeller drive (5) and applies said safety brake (35) in the event of the detection of a fault in the angular position control of the propeller drive (5).

12. The method according to claim 11, characterized in that the control unit (31) comprises a first microcomputer which executes a control program for the servo motor (26) and the monitoring device (36) comprises a second microcomputer which executes a monitoring program for ascertaining that there is a fault in the angular position control of the propeller drive (5) and applies said safety brake (35) in the event of the detection of a fault in the angular position control of the propeller drive (5).

13. The method according to claim 12, characterized in that the first and the second microcomputer consist of two separate units, each of which comprises at least a processor (37, 39) and a memory (38, 40).

14. The method according to claim 10, characterized in that the monitoring device (36) ascertains that there is a fault in the angular position control of the propeller drive (5) on the basis of an input signal from said position sensor (33), corresponding to the actual position (ϕ), and an input signal from a control device (30, 32), corresponding to a required position (θ).

15. The method according to claim 14, characterized in that the monitoring device (36) ascertains that there is a fault in the angular position control of the propeller drive if a first function ($f_1$) of the difference between the actual position (ϕ) and the required position (θ) is greater than a first limit value ($\gamma_1$) and/or a second function of the convergence speed of the actual position (ϕ) towards the required position (θ) is less than a second limit value ($\gamma_2$) and/or is greater than a third limit value ($\gamma_3$) and/or a third function ($f_3$) of the acceleration of the actual position is less than a fourth limit value ($\gamma_4$) and/or is greater than a fifth limit value ($\gamma_5$).

16. The method according to claim 15, characterized in that the monitoring device (36) carries out a verification that there is a fault in the angular position control before the safety brake (35) is applied when the monitoring device (36) has ascertained that there is a fault in the angular position control.

17. The method according to claim 16, characterized in that said verification is carried out by a time delay for the application of said safety brake (35) from the time that the monitoring device (36) ascertained that there was a fault in the angular position control of the propeller drive (5).

18. The method according to claim 17, characterized in that the size of said time delay is dependent upon said first and/or second function.

* * * * *